United States Patent [19]

Garsin

[11] Patent Number: 4,533,236

[45] Date of Patent: Aug. 6, 1985

[54] CHARGE PARTICLE REMOVAL DEVICE

[75] Inventor: Paul A. Garsin, Webster, N.Y.

[73] Assignee: Xerox Corporation, Stamford, Conn.

[21] Appl. No.: 556,801

[22] Filed: Dec. 1, 1983

[51] Int. Cl.[3] ..... G03G 21/00

[52] U.S. Cl. ..... 355/15; 15/1.5 R; 15/256.51

[58] Field of Search ..... 355/15, 3 R, 14 R; 118/652; 430/125; 15/1.5, 256.51, 256.52

[56] References Cited

U.S. PATENT DOCUMENTS

| | | | |
|---|---|---|---|
| 3,572,923 | 3/1971 | Fisher et al. | 355/15 |
| 3,580,673 | 5/1971 | Yang | 355/15 |
| 3,722,018 | 3/1973 | Fisher | 15/1.5 |
| 3,944,354 | 3/1976 | Benwood et al. | 355/15 X |
| 3,994,725 | 11/1976 | Volkers | 355/15 X |
| 4,252,433 | 2/1981 | Sullivan | 15/1.5 R |
| 4,265,990 | 5/1981 | Stolka | 430/59 |

FOREIGN PATENT DOCUMENTS

| | | | |
|---|---|---|---|
| 0046684 | 3/1982 | European Pat. Off. | 355/15 |

*Primary Examiner*—R. L. Moses

[57] ABSTRACT

Magnetic brush cleaner for removing residual charged particles such as toner from a charge-retentive surface such as a photoreceptor. The brush cleaner has a bias voltage applied thereto for establishing an electrostatic field for aiding in toner removal. A control is provided for varying the bias voltage applied to the brush cleaner in accordance with variations in photoreceptor potential to thereby maintain the cleaning potential (i.e. the difference between the applied bias voltage and the photoreceptor potential) invariant.

10 Claims, 3 Drawing Figures

Figure 1:
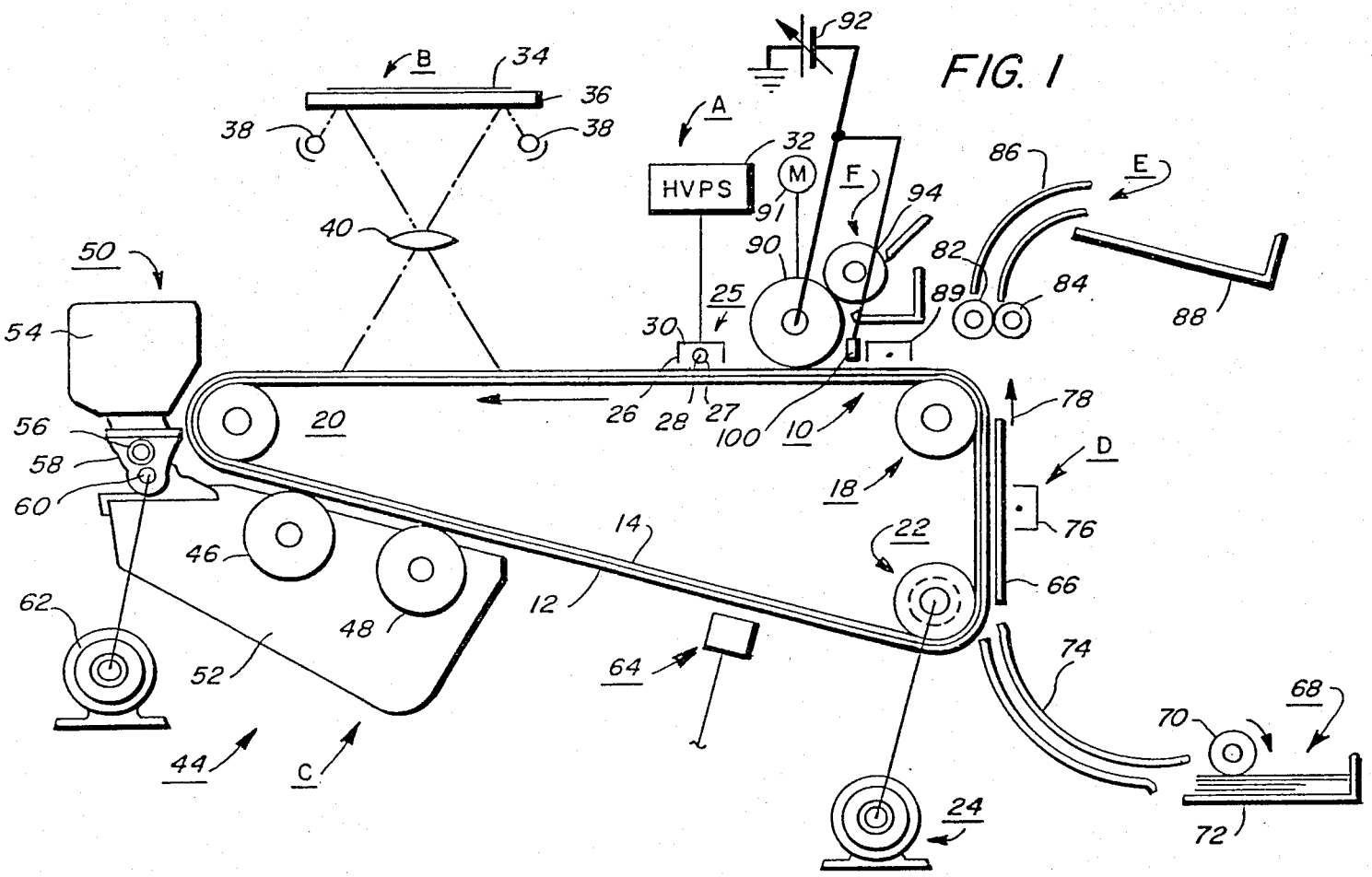

CHARGE OF RESIDUAL TONER (MICRO-COULOMB / GRAM)
35.0
30.0
25.0
20.0
15.0
10.0
5.0
0
-20
-10
0
10
20
30
40
50
60
70
80
CLEANING POTENTIAL (VOLTS)
110 (SCAVENGING BOUNDRY)
112
108 (REDEPOSITION BOUNDRY)

REFERENCE CLEANING POTENTIAL
104
102
CONTROLLER
106
CLEANING POWER SUPPLY
V/P/R
V/BIAS
100
ELECTROSTATIC VOLTMETER
90
CLEANING MEMBER

CHARGE PARTICLE REMOVAL DEVICE

This invention relates generally to an electrophotographic printing machine, and more particularly to an improved cleaning system for use therein.

In electrophotographic printing, a charge retentive surface for, for example, a photoconductive member or photoreceptor is uniformly charged to sensitize the surface thereof. The charged photoconductive member is exposed to a light image of an original document being reproduced. Exposure of the sensitized photoconductive surface discharges the charge selectively. This records an electrostatic latent image on the photoconductive surface corresponding to the informational areas contained within the original document being reproduced. Development of the electrostatic latent image recorded on the photoconductive surface is achieved by bringing a developer material into contact therewith. Typical developer materials comprise a heat settable plastic powder, known in the art as toner, which adheres triboelectrically to coarser carrier granules, for example, ferromagnetic granules. The toner particles are selected to have the appropriate charge relative to the electrostatic latent image recorded on the photoconductive surface. Thus, when the charge on the photoreceptor is negative the toner is charged positively. When the developer material is brought into contact with the latent electrostatic image on the photoconductive surface, the toner particles transfer from the carrier granules to the electrostatic latent image. This forms a powder image on the photoconductive surface.

The toner image on a reusable photoconductive surface is subsequently transferred to a sheet of support material such as plain paper. All of the toner forming the images does not transfer to the sheet. The toner remaining on the photoconductive surface which is referred to as residual toner must be removed from the photoconductive surface otherwise subsequent image formation will be adversely affected.

Heretofore, various devices such as blades, foam rollers, conductive brushes, non-conductive brushes and magnetic brushes have been employed for toner removal from the photoreceptor.

It has been found that establishing an electrostatic field between the photoreceptor and a cleaning member such as a fiber brush or a magnetic brush enhances toner removal from the photoreceptor. Such arrangements are disclosed in U.S. Pat. Nos. 3,572,923 and 3,722,018 granted to Fisher et al. on Mar. 22, 1973, and Fisher on Mar. 30, 1971, respectively. Likewise, when an electrostatic field is established between the brush and a brush detoning member removal of toner from the brush is improved. The creation of the electrostatic field between the brush and photoreceptor may be accomplished by applying a d.c. voltage to the brush. The field established between the brush an the insulative photoreceptor is such that the toner on the photoreceptor is attracted to the brush. Thus, if the toner on the photoreceptor is negatively charged then the aforementioned field would be less negative relative to the charge on the toner.

The cleaning performance latitude window for magnetic brush cleaners is defined mainly by two failure phenomena, therefore, scavenging and redeposition. Scavenging failure occurs when conditions of the process are such that the carrier beads are no longer able to remove a sufficient portion of the residual toner from the photoreceptor. When redeposition failure occurs, the cleaner acts like a development system, in that, toner is transferred or redeposited from the carrier beads to the photoreceptor. The plot of charge on the toner as it enters the cleaning nip versus cleaning potential defines both the scavenging and redeposition boundaries. Scavenging failure occurs at low cleaning potential while the redeposition failure occurs at high cleaning potentials and the range or area between the two boundaries defines the operating latitude on the cleaning potential axis.

The cleaning potential is an implicit measure of the electrical field that is acting on the toner in the cleaning nip and is traditionally defined as the difference between the bias voltage applied to the magnetic brush cleaner and the electrical potential on the photoreceptor or other charge-retentive surface. Heretofore, the bias on magnetic cleaners has been fixed at a predetermined level depending on the conditions of the system in which they have been used. As will be understood when the cleaner bias is fixed the cleaning potential will vary with any variation in photoreceptor potential. Thus, if photoreceptor potential is higher than a predetermined value the cleaning potential decreases and if it is lower than the predetermined value then the cleaning potential is higher.

The scavenging phenomena is fairly insensitive to carrier bead material aging or initial properties whereas the redeposition phenomena is quite sensitive to material aging as well as photoreceptor potential variation. As carrier bead material ages (i.e. tribo properties degrade) the redeposition boundary shifts towards the scavenging boundary thereby reducing the cleaning latitude window.

In a xerographic system where there is a large variation in photoreceptor potentials and the bias applied to the magnetic cleaner is fixed, there is a requirement for a large cleaning latitude window. Such a requirement defines the useful life of the carrier as well as limiting the range of some of the material functional properties at time zero. As long as cleaning latitude, as delineated by the cleaning failure modes, is equal to the cleaning potential required due to the photoreceptor variations satisfactory cleaning may be had. However, due to the fixed bias on the cleaning brush and the shifting of the redeposition boundary toward the scavenging boundary as the result of carrier bead aging, the useful life of the carrier beads is curtailed.

Briefly, the present invention provides an improved toner removal apparatus for use in electrophotographic printing xerography. The apparatus comprises an electrically conductive magnetic brush to which a voltage is applied which brush is rotated in contact with an insulative imaging surface to remove toner therefrom. An insulative detoning roll to which a voltage of the same polarity as applied to the brush but of a larger value is rotated in contact with the conductive brush for removing toner therefrom.

A preclean charging device is provided which serves to charge the toner on the surface prior to being contacted by the brush. The polarity of the preclean device is opposite to that of the conductive brush and can be the same as the transfer discharge device or the opposite polarity.

An electrometer is provided for measuring the photoreceptor potential just prior to entry into the cleaning nip. This measurement is used to maintain the cleaning potential constant at a predetermined value which value is chosen so that carrier bead life is optimized. Thus, the photoreceptor potential is compared to a reference value in order to drive an electrical signal which can be used as an input to the power supply of the magnetic brush. Therefore, if the difference between this and a fixed reference value measured photoreceptor potential is greater than a predetermined value then the bias applied to the magnetic cleaning brush is decreased and if this difference is less than the predetermined value the brush bias is increased.

Figure 2:
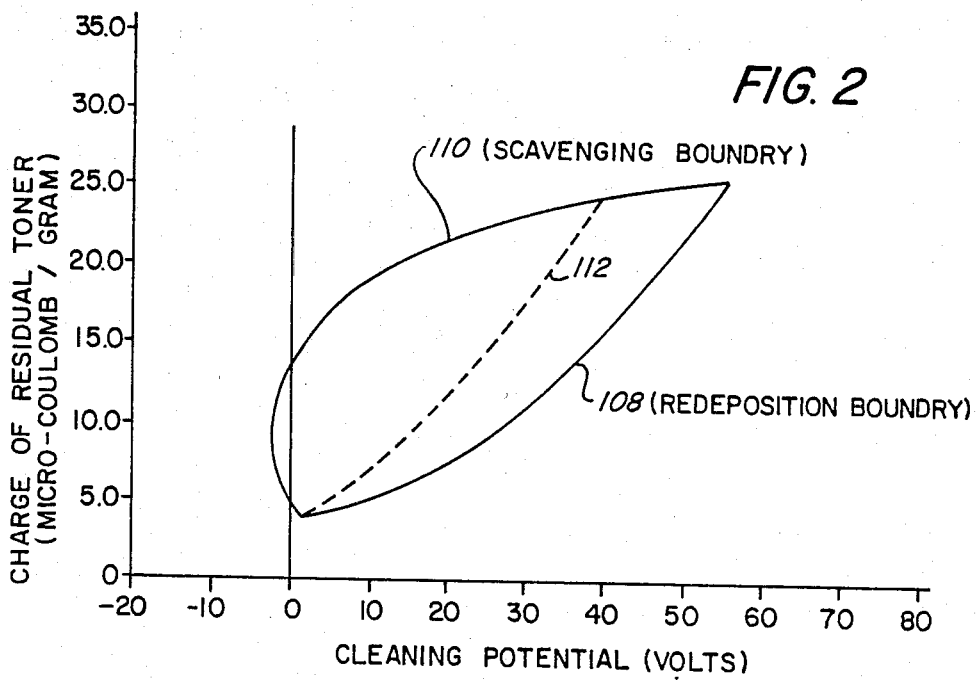
Figure 3:
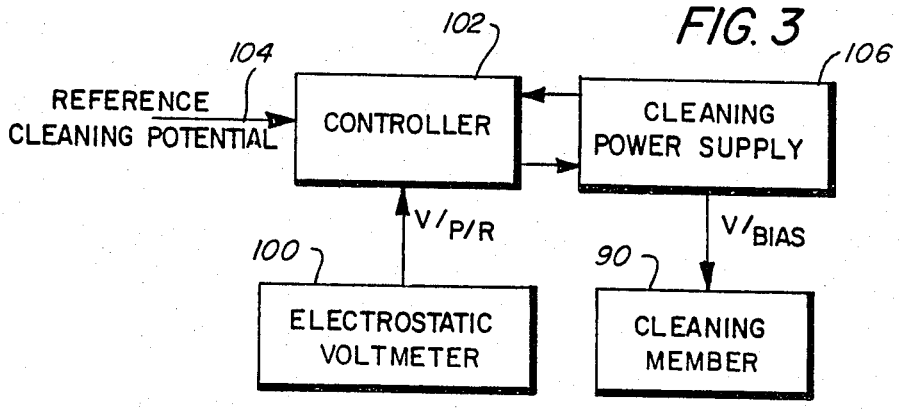

Other aspects of the present invention will become apparent as the following description proceeds with reference to the drawings, in which:

FIG. 1 is a schematic elevational view of an electrophotographic machine incorporating the features of the present invention therein; and FIG. 2 is a plot of charge on toner entering the cleaning nip versus cleaning potential; and FIG. 3 is a schematic diagram of a control circuit for the cleaner used in the machine of FIG. 1.

For a general understanding of the features of the present invention, a description thereof will be made with reference to the drawings. FIG. 1 schematically depicts the various components of an illustrative electrophotographic printing machine and cleaning apparatus incorporating the apparatus and method of the present invention.

Inasmuch as the art of electrophotographic printing is well known, the various processing stations employed in the printing machine illustrated in FIG. 1 will be described briefly.

As shown in FIG. 1, the printing machine utilizes a photoconductive belt 10 which consists of an electrically conductive substrate 14, a charge generator layer 12 photoconductive particles randomly dispersed in an electrically insulating organic resin and a charge transport electrically inactive polycarbonate resin having dissolved therein one or more diamines. A photoreceptor of this type is disclosed in U.S. Pat. No. 4,265,990 issued May 5, 1981 in the name of Milan Stolka et al., the disclosure of which is incorporated herein by reference. Belt 10 moves in the direction of arrow 16 to advance successive portions thereof sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device indicated generally by the reference numeral 25, charges the belt 10 to a relatively high, substantially uniform negative potential. A suitable corona generating device for negatively charging the photoconductive belt 10 comprises a conductive shield 26 and a dicorotron electrode comprising an elongated bare wire 27 and a relatively thick electrically insulating layer 28 having a thickness which precludes a net d.c. corona current when an a.c. voltage is applied to the corona wire and when the shield and the photoconductive surface are at the same potential. Stated differently, in the absence of an external field supplied by either a bias applied to the shield or a charge on the photoreceptor there is substantially no net d.c. current flow.

Next, the charged portion of photoconductive surface is advanced through exposure station B. At exposure station B, an original document 34 is positioned facedown upon a transparent platen 36. Lamps 38 flash light rays onto original document 34. The light rays reflected from the original document 34 are transmitted through lens 40 forming a light image thereof. Lens 40 focuses the light image onto the charged portion of photoconductive surface 12 to selectively dissipate the charge thereon. This records an electrostatic latent image on photoconductive surface 12 which corresponds to the informational areas contained within original document 34.

At development station C, a magnetic brush development system, indicated generally by the reference numeral 44 advances a developer material into contact with the electrostatic latent image and the test areas. Preferably, magnetic brush development system 44 includes two magnetic brush developer rollers 46 and 48. These rollers each advance the developer material into contact with the latent image. Each developer roller forms a brush comprising carrier granules and toner particles. The latent image attracts the toner particles from the carrier granules forming a toner powder image on the latent image. As successive electrostatic latent images are developed, toner particles are depleted from the developer material. A toner particle dispenser, indicated generally by the reference numeral 50, is arranged to furnish additional toner particles to housing 52 for subsequent use by developer rollers 46 and 48 respectively. Toner dispenser 50 includes a container 54 storing a supply of toner particles therein. A foam roller 56 disposed in a sump 58 coupled to container 54 dispenses toner particles into an auger 60. Auger 60 comprises a helical spring mounted in a tube having a plurality of apertures therein. Motor 62 rotates the helical member of auger to advance the toner particles through the tube 30 that toner particles are disposed from the apertures thereof.

A sheet of support material 66 is moved into contact with the toner powder image at transfer station D. The sheet of support material is advanced to transfer station D by sheet feeding apparatus 68. Preferably, sheet feeding apparatus 68 includes a feed roll 70 contacting the uppermost sheet of stack 72. Feed rolls 70 rotate so as to advance the uppermost sheet from stack 72 into chute 74. Chute 74 directs the advancing sheet of support material into contact with photoconductive surface 12 of belt 10 in a timed sequence so that the toner powder image developed thereon contacts the advancing sheet of support material at transfer station D.

Transfer station D includes a corona generating device 76 which sprays negative ions onto the backside of sheet 66. This attracts the positively charged toner powder image from photocondutive surface 12 to sheet 66. After transfer, the sheet continues to move, in the direction of arrow 78, onto a conveyor (not shown) which advances the sheet of fusing station E.

Fusing station E includes a fuser assembly, indicated generally by the reference numeral 80, which permanently affixes the transferred powder image to sheet 66. Preferably, fuser assembly 80 comprises a heated fuser roller 82 and a back-up roller 84. Sheet 66 passes between fuser roller 82 and back-up roller 84 with the toner powder image contacting fuser roller 82. In this manner, the toner powder image is permanently affixed to sheet 66. After fusing, chute 86 guides the advancing sheet 66 to catch tray 88 for subsequent removal from the printing machine by the operator.

After the sheet of support material is separated from photoconductive surface of belt 10, the residual toner particles to photoconductive surface are removed therefrom. These particles are removed from photoconductive surface at cleaning station F. Prior to the toner to be removed at the cleaning station F, it moves past a preclean dicorotron 89. The preclean dicorotron generates positive ions which serve to charge the toner positively.

At cleaning station F, thre is a magnetic brush 90. The brush 90 is supported for rotation in contact with the photoconductive surface, a motor 91 being provided for effecting rotation. A source 92 of d.c. potential is operatively connected to the brush 90 such that an electrostatic field is established between the insulative member 10 and the brush to thereby cause attraction of the charged toner particles from the surface 10. The applied voltage is preferably on the order of −190 volts.

An insulative detoning roll 94 is supported for rotation in contact with the conductive brush 90 and at twice the speed of the brush. A source of d.c. voltage 96 electrically biases the roll 94 to the same polarity as the brush 90 is biased. However, the magnitude of this bias is greater than the bias applied to the brush. For example, a suitable bias would be −400 volts. Preferably the roll 92 is fabricated from anodized aluminum whereby the surface of the roll contains an oxide layer of about 20 to 30 microns and is capble of leaking charge to preclude excessive charge build-up on the detoning roll. The roll 92 is supported for rotation by a motor 93.

A scraper blade 98 contacts the roll 94 for removing the toner therefrom and causing it to fall into a collector 100.

When using the type of photoreceptor disclosed in the aforementioned '990 patent, the cleaning potential range between scavenging failure and redeposition failure is required to be of a certain minimum magnitude in order to accommodate the large range of possible photoreceptor potentials at the entrance of the cleaning nip. The large variation in photoreceptor potentials at this point is caused by the erratic and unpredictable response of this type of photoreceptor to positive preclean which approximately scans the total range between no charging and capacitive charging. The variation in the photoreceptor potential following the transfer step also contributes to the variation in the erratic photoreceptor potential at the cleaning nip.

This problem has been minimized by the present invention by maintaining the cleaning potential constant. This is accomplished by varying the electrical bias applied to the cleaning roller in response to variation in the photoreceptor potential from a predetermined value. To this end, there is provided an electrometer 100 which may be of any commercial available device used in connection with the xerographic process. The electrometer measures the potential on a portion of the photoreceptor just prior to its entry into the cleaning nip. This measurement is directed to a conventional controller 102 (FIG. 3) which also has inputted thereto via conductor 104 a reference cleaning potential value. The controller which may be of any conventional design capable of deriving a signal representative of the difference between the reference cleaning potential and the voltage measurement by the electrometer or electrostatic voltmeter 100, the signal being used to vary the bias applied to a cleaning brush power supply 106 to thereby maintain the cleaning potential invariant regardless of photoreceptor potential fluctuation.

The cleaning performance latitude window for *magnetic* brush cleaners is defined mainly by failure phenomena, therefore, scavenging and redeposition. Scavenging failure occurs when conditions of the process are such that the carrier beads are no longer able to remove a sufficient portion of the residual toner from the photoreceptor. When redeposition failure occurs, the cleaner acts like a development system, in that, toner is transferred or redeposited from the carrier beads to the photoreceptor. The plot (see FIG. 2) of charge on the toner as it enters the cleaning nip versus cleaning potential defines both the scavenging and redeposition boundaries. Scavenging failure occurs at low cleaning potentials while the redeposition failure occurs at high cleaning potentials and the range or area between the two boundaries 108 and 110 defines the operating latitude on the cleaning potential axis.

The cleaning potential is an implicit measure of the electrical field that is acting on the toner in the cleaning nip and is traditionally defined as the difference between the bias voltage applied to the magnetic brush cleaner and the electrical potential on the photoreceptor or other charge-retentiive surface. Heretofore, the bias on magnetic cleaners has been fixed at a predetermined level depending on the conditions of the system in which they have been used. As will be understood when the cleaner bias is fixed the cleaning potential will vary with any variation in photoreceptor potential. Thus, if photoreceptor potential is higher than a predetermined value the cleaning potential decreases and if it is lower than the predetermined value then the cleaning potential is higher.

The scavenging phenomena is fairly insensitive to carrier bead material aging or initial properties whereas the redeposition phenomena is quite sensitive to material aging as well as photoreceptor potential variation. As carrier bead material ages (i.e. tribo properties degrade) the redeposition boundary shifts as illustrated by the dotted curve 104 in FIG. 2 towards the scavenging boundary thereby reducing the cleaning latitude window.

In a xerographic system where there is a large variation in photoreceptor potential and the bias applied to the magnetic cleaner is fixed, there is a requirement for a large cleaning latitude window. Such a requirement defines the useful life of the carrier as well as limiting the range of some of the material functional properties at time zero. As long as cleaning latitude, as delineated by the cleaning failure modes, is equal to the cleaning potential required due to the photoreceptor variations satisfactory cleaning may be had. However, due to the fixed bias on the cleaning brush and the shifting of the redeposition boundary represented by the dotted line 112 toward the scavenging boundary as the result of carrier bead aging, the useful life of the carrier beads is curtailed.

As can be seen from a consideration of FIG. 2, when the potential difference between the cleaning brush and the photoconductive surface is low, the effect on the cleaning latitude window by the shifting of the redeposition boundary is minimized. In other words, this window is maximized thereby extending carier bead life.

I claim:

1. Apparatus for removing charged particles from a charge-retentive surface, said apparatus comprising:

a magnetic brush cleaner structure, including magnetically attractable elements;

means for applying a bias voltage to said brush cleaner structure;

means for moving said brush relative to said charge-retentive surface to thereby remove charged particles therefrom; and means for maintaining constant the difference between said bias voltage and the potential on said charge-retentive surface.

2. Apparatus according to claim 1 wherein said difference is relatively low whereby the performance cleaning latitude is maximized.

3. Apparatus according to claim 2 wherein said charge-retentive surface comprises a photoreceptor.

4. Apparatus according to claim 3 wherein said magnetically attractable elements comprise carrier beads.

5. Apparatus according to claim 1 wherein said difference maintaining means comprises means for varying said bias voltage in response to a variation in said potential.

6. Apparatus according to claim 5 wherein said charge-retentive surface comprises a photoreceptor.

7. Apparatus according to claim 6 wherein said magnetically attractable elements comprise carrier beads.

8. Apparatus according to claim 1 including means for detoning said brush cleaner.

9. Apparatus according to claim 2 including means for detoning said brush cleaner.

10. Apparatus according to claim 5 including means for detoning said brush cleaner.

* * * * *